US005213735A

United States Patent [19]

Schneider et al.

[11] Patent Number: 5,213,735

[45] Date of Patent: May 25, 1993

[54] PROCESS FOR MANUFACTURING NEEDLED SPUNBONDEDS

[75] Inventors: Heinrich Schneider, Niederneukirchen; Heinz Bocksrucker, Puchenau; Karl Muhlberghuber, St. Pantaleon, all of Austria

[73] Assignee: Polyfelt Gesellschaft m.b.H., Linz, Austria

[21] Appl. No.: 719,344

[22] Filed: Jun. 24, 1991

[30] Foreign Application Priority Data

Jul. 2, 1990 [AT] Austria ..... 1401/90

[51] Int. Cl.[5] ..... D01D 5/00; D04H 1/46

[52] U.S. Cl. ..... 264/103; 28/107; 28/112; 264/126

[58] Field of Search ..... 264/103, 126; 28/107, 28/112

[56] References Cited

U.S. PATENT DOCUMENTS

| | | | |
|---|---|---|---|
| 3,660,555 | 5/1972 | Rains et al. | 264/126 |
| 3,994,759 | 11/1976 | Stoller | 156/85 |
| 4,632,858 | 12/1986 | Knoke et al. | 428/287 |

FOREIGN PATENT DOCUMENTS

| | | | |
|---|---|---|---|
| 363707 | 4/1990 | European Pat. Off. . | |
| 2251118 | 4/1973 | Fed. Rep. of Germany . | |
| 3009116 | 7/1989 | Fed. Rep. of Germany . | |
| 49-47422 | 12/1974 | Japan | 264/126 |

*Primary Examiner*—Leo B. Tentoni
*Attorney, Agent, or Firm*—Wenderoth, Lind & Ponack

[57] ABSTRACT

Process for manufacturing needled spunbondeds from thermoplastic fibers wherein, prior to the needling, the as-spun web is thermally sealed at the surfaces and provided with a lubricant.

6 Claims, No Drawings

PROCESS FOR MANUFACTURING NEEDLED SPUNBONDEDS

BACKGROUND OF THE INVENTION

1. Field of the Invention

The invention relates to a process for manufacturing needled spunbondeds wherein, prior to the needling, the continuous filament web is thermally sealed only at the surface with a lubricant.

2. Description of the Related Art

As already known from DE Patent 3,009,116, to obtain advantageous web properties, in particular to obtain a high web strength and web uniformity, it is essential that the web be treated with a fiber finish prior to the needling. The treatment of the webs with a fiber finish prior to the needling improves the sliding properties, which makes it possible to avoid needle breakages during the needling on the one hand and filament damage on the other. The fiber finish in question was applied by means of nozzles or by dipping. However, application by means of nozzles was found to have the disadvantage that the jet action partially destroys the coherence and integrity of the still loose and unconsolidated web. Similarly, dipping of the loose filament assembly, for example in a liquid lubricant bath or in foam, was found to destroy the web structure. It was therefore necessary, before any fiber finish was to be applied, to stabilize the web slightly by means of light preneedling. However, this had the disadvantage that, to avoid excessive damage to the non-fiber-finished web and to avoid needle breakages, the production speed had to be greatly reduced.

According to DE Patent 3,009,116, this disadvantageous operation of preneedling can be eliminated by depositing the still unconsolidated, as-spun web on a rotating sieve drum where the fiber finish in the form of a mist is sucked through the web by means of a vacuum and aspirated away on the inside of the sieve drum via a plurality of suction zones. The disadvantage of this improvement is in particular that the basis weight uniformity of the web is still not satisfactory, that high production speeds are not possible, and that a relatively complicated web formation apparatus involving a vacuu and complicated controls is required.

SUMMARY OF THE INVENTION

It is an object of the present invention to avoid the above-described disadvantages and in particular to provide a process whereby a uniform web having good mechanical properties can be manufactured at a high production speed. It has been found that this object is achieved when the as-spun web is thermally sealed only at the surfaces.

DESCRIPTION OF THE PREFERRED EMBODIMENTS

The present invention accordingly provides a process for manufacturing needled spunbondeds from thermoplastic fibers, wherein filaments are spun, stretched and formed into a web, with the improvement that the web is then a) thermally sealed at both surfaces, b) provided with a lubricant, and c) consolidated by needling, whereby simultaneously the sintering at the crossing points of the filaments on the incipiently sealed web surface is undone again.

The process makes it possible that the web, which is only very lightly sealed at the surface, can be transported and provided with lubricant without destroying the web structure. The lubricant penetrates through the incipiently sealed web surfaces into the web and effects a thorough impregnation which is suitable for the subsequent needling even at high production speeds. Using the process it is possible to manufacture spunbondeds of good basis weight uniformity at approximately twice the production speed of existing processes, in special cases at still higher production speeds. According to the present invention, it is possible, depending on the web weight, to obtain speeds of up to about 40 m/min, in special cases of up to about 60 m/min. In conventional processes for manufacturing needled spunbondeds, the production speeds are not more than about 20 m/min. The high production speeds according to the present invention are possible in particular on account of the replacement of the limiting operations of preneedling or fiber finishing on a sieve drum by means of a vacuum for the significantly faster operation of thermal sealing. The thermal sealing of the web surfaces has the effect of lightly sintering the surface filaments to one another at their crossing points without fusing the filaments to one another. More particularly, the surfaces of these fibers at the web surface are softened without melting, which produces a kind of sintering effect at the crossing points of the fibers. The bonding between the filaments due to the incipient sealing is reversible and is undone again during the needling, so that the final end product is a web whose consolidation is due to needling alone and not due to thermal fusion.

According to the invention, the thermal sealing of the webs at their surfaces only, leaving the core zone of the webs unconsolidated, produces adequately loadbearing, transportable and fiber-finishable filament assemblies whose structure is not destroyed during lubricant application. This produces after needling, where the incipient sealing of the surface layers is undone, a web of high uniformity. In the Examples the uniformity of the webs is reported in terms of the coefficient of variation c" in accordance with DIN 53854.

Preferably, the two web surfaces are incipiently sealed only to a depth of not more than 0.2 mm.

The thermal sealing can be effected for example by means of heated rolls, belts, platens or surfaces or by means of radiant heaters, for example IR radiators. Preference is given to using heated rolls, particular preference is given to guiding the web through the nip between two calender rolls. The roll temperature and the surface temperature of the web are below the melting point of the thermoplastic filaments used. For example, in the case of polypropylene webs (melting point 165° C.), the calender rolls are preferably heated to about 120–140° C. The advantage of using a calender for this purpose is that the roll pressure intensifies the sintering effect at the crossing points of the softened but unmelted fibers. Not only the size of the roll nip but also the roll pressure can be optimized to the particular web weights, the filament fineness, the temperature, the thermoplastic filaments used and the production speed.

The process of the present invention is suitable for manufacturing webs from all thermoplastics suitable for the spunbonding technique. It is preferably used for manufacturing spunbondeds from polyolefin filaments, for example polyethylene or polypropylene filaments, polyamide filaments or polyester filaments. Particular preference is given to using polypropylene filaments, not only filaments made of polypropylene homopolymers but also propylene-ethylene copolymers. The basis weights of the manufactured webs range from about 30 to 2500 g/n$^2$, preferably from about 100 to 2000 g/m$^2$.

As lubricant it is possible to use not only water but also the fiber finishes customary in textile technology, as described for example in DE Patent 3,009,116. The lubricant can be applied in a conventional manner, for example by spraying or by means of impregnating rolls.

The subsequent needling is effected on known needling machines, for example as described in DE Patent 3,009,116, where single- or multiple-stage needling is effected to the desired degree of consolidation.

EXAMPLE 1

Polypropylene having an MFI (melt flow index at 230° C. under a load of 2.16 kg in accordance with DIN 53735) of 17-21 and a molecular weight distribution of 2.3-2.7 was melted in an extruder at 230-260.C. and spun from a 1 m wide experimental spinning pack through spinnerets into fibers, and the fibers were aerodynamically taken off, stretched to a fineness of 8-12 dtex and deposited on a moving belt to form a random-laid filament structure. A belt speed of 25 m/min produced a web having a basis weight of 110 g/n$^2$. The still unconsolidated sheet structure was then introduced via a feed belt into a two-roll calender. The oil-heated calender rolls, which had a surface temperature of 125° C.-130° C., were applied to the loose web structure with a line pressure of 30-35 N/mm, which produced a reversible consolidation effect in which only the fibers which were at the web surfaces came under the heat influence and were softened and compressed by the roll pressure, producing a kind of sintering effect at the crossing points of the fibers. This produced adequately load-bearing but later undoable surface layers on the upper side and the underside of the web, the layer thickness being less than 0.1 mm. The core zone of the web, comprising in this case at least 80% of the fibers, remained unconsolidated.

This pre-web was then wetted with a lubricant on a pad-mangle. Then the surface-sealed and fiber-finished web was subjected to two-stage needling (each stage with 80 needle insertions/cm$^2$) in the course of which the incipiently sealed web surface became completely loose again.

The web obtained had the following properties:

| | |
|---|---|
| Basis weight (DIN 53 854) | 110 g/m$^2$ |
| Basis weight uniformity $c_v$ (DIN 53854) | 8% |
| Strip tensile strength (DIN 53 857/2) | 780N/10 cm |
| Plunger puncture resistance × (DIN 54 307) | 1320N |

EXAMPLE 2

Example 1 was repeated with a belt speed of 3 m/min to produce a web having a basis weight of 1000 g/m$^2$. The preconsolidation was carried out at a roll surface temperature of 120"C-125"C and a line pressure of 35-40 N/mm. The thickness of the incipiently sealed surface layer was 0.2 mm, leaving at least 90-95% of the fibers unconsolidated.

| Web properties: | |
|---|---|
| Basis weight | 1000 g/m$^2$ |
| Basis weight uniformity | 4% |
| Strip tensile strength | 5200N/10 cm |

-continued

| Web properties: | |
|---|---|
| Plunger puncture resistance | 6800N |

EXAMPLE 3

Example 1 was repeated with a belt speed of 35 m/min to produce a web having a basis weight of 70 g/m$^2$. The preconsolidation was carried out at a roll surface temperature of 130-135° C. and a line pressure of 20-30 N/mm. The thickness of the incipiently sealed surface layer was 0.05 mm, leaving at least 60% of the fibers unconsolidated.

| Web properties: | |
|---|---|
| Basis weight | 70 g/m$^2$ |
| Basis weight uniformity | 9% |
| Strip tensile strength | 430N/10 cm |
| Plunger puncture resistance | 840N |

EXAMPLE 4

Example 1 was repeated with the polyester having an MFI (280° C./2.16 kg) of 40-45 and a relative viscosity of 1.3-1.4, which was spun at 280-300° C. into fibers having a fineness of 2-8 dtex, which were formed at a production speed of 27 m/min into a web having a basis weight of 100 g/m$^2$. The preconsolidation in the calender took place at a roll surface temperature of 180-190° C. and a line pressure of 25-30 N/mm.

| Web properties: | |
|---|---|
| Basis weight | 100 g/m$^2$ |
| Basis weight uniformity | 8% |
| Strip tensile strength | 680N/10 cm |
| Plunger puncture resistance | 1140N |

EXAMPLE 5

Example 1 was repeated with nylon-6 having a relative viscosity of 2.4-2.5, which was spun at 300-310° C. into fibers having a fineness of 6-8 dtex, which were formed at a production speed of 10 m/min into a web having a basis weight of 250 g/m$^2$. The preconsolidation in the calender took place at a roll surface temperature of 190-200° C. and a line pressure of 30-35 N/mm.

| Web properties: | |
|---|---|
| Basis weight | 250 g/m$^2$ |
| Basis weight uniformity | 6% |
| Strip tensile strength | 1710N/10 cm |
| Plunger puncture resistance | 2800N |

EXAMPLE 6

Example 1 was repeated with polyethylene (HDPE) having an MFI (190° C./2.16 kg) of 12-14, which was spun at 210-240° C. into fibers having a fineness of 8-12 dtex, which were formed at a production speed of 25 m/min into a web having a basis weight of 110 g/m$^2$. The preconsolidation in the calender took place at a roll surface temperature of 90-100° C. and a line pressure of 25-30 N/mm.

| Web properties: | |
|---|---|
| Basis weight | 110 g/m$^2$ |
| Basis weight uniformity | 8% |
| Strip tensile strength | 550N/10 cm |
| Plunger puncture resistance | 920N |

What we claim is:

1. In a process for manufacturing needled spunbondeds from thermoplastic fibers, which comprises spinning filaments, stretching the filaments, forming the stretched filaments into a web in which the filaments have crossing points with each other, and needling the web to form spunbonded, the improvement which comprises, before the needling, thermally sealing the web at both its surfaces to temporarily bond the filaments at the crossing points and thereby form an incipiently sealed web surface, and then providing lubricant into the web, and wherein the web is consolidated by the needling and simultaneously the bonds at the crossing points of the filaments are broken.

2. A process according to claim 1, wherein the two web surfaces are sealed to a depth of not more than 0.2 mm.

3. A process according to claim 1, wherein the web surfaces are sealed by means of heated rolls.

4. A process according to claim 1, wherein the web surfaces are sealed by means of heated calender rolls.

5. A process according to claim 1, wherein the thermoplastic filaments are polyolefin filaments, polyamide filaments or polyester filaments.

6. A process according to claim 1, wherein the thermoplastic filaments are made of polypropylene.

* * * * *